US006794014B2

(12) United States Patent
Winter et al.

(10) Patent No.: US 6,794,014 B2
(45) **Date of Patent: *Sep. 21, 2004**

(54) GEMSTONE

(75) Inventors: Ernst Michael Winter, Hamburg (DE); Lothar Schäfer, Abbesbüttel (DE); Thorsten Matthee, Meine (DE)

(73) Assignee: Winter CVD Tecknik GmbH (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/319,142

(22) PCT Filed: Sep. 23, 1998

(86) PCT No.: PCT/EP98/06074

§ 371 (c)(1),
(2), (4) Date: Jul. 29, 1999

(87) PCT Pub. No.: WO99/16328

PCT Pub. Date: Apr. 8, 1999

(65) Prior Publication Data

US 2001/0049003 A1 Dec. 6, 2001

(30) Foreign Application Priority Data

Sep. 30, 1997 (DE) ..... 297 17 496 U

(51) Int. Cl.[7] ..... B32B 9/00; C30B 29/00

(52) U.S. Cl. ..... 428/156; 428/15; 428/172

(58) Field of Search ..... 428/15, 156, 172, 428/66.5, 137, 161, 408; 501/86; 63/32, 33, 34; 117/84; 423/446

(56) References Cited

U.S. PATENT DOCUMENTS 229,328 A * 6/1880 Meyer
2,521,846 A * 9/1950 Gregory ..... 49/92.5
5,431,028 A * 7/1995 Lampert et al. ..... 63/2
5,882,786 A * 3/1999 Nassau et al. ..... 428/336

* cited by examiner

*Primary Examiner*—Harold Pyon
*Assistant Examiner*—Alicia Chevalier
(74) *Attorney, Agent, or Firm*—R W Becker & Associates; R W Becker

(57) ABSTRACT

A gemstone is provided and has a large surface-area, plate-shaped support having a surface with least one pyramid-shaped depression. A thin vapor phase deposit layer comprises a thin, surface-shaped precious synthetic gemstone layer disposed on the large surface-area, plate-shaped support and has an upper surface facing away from the plate-shaped support and an underside having at least one pyramid-shaped projection disposed in and coinciding with the pyramid-shaped depression of the support. Side faces of the pyramid-shaped projections of the underside of the vapor phase deposit layer upon the plate-shaped support impart decorative, diamond-light-reflective qualities to the synthetic gemstone layer.

15 Claims, 2 Drawing Sheets

GEMSTONE

BACKGROUND OF THE INVENTION

The present invention relates to artificial gemstones.

Gemstones, especially precious stones, are cut or polished before they are mounted in the metal body of a piece of jewelry in order to provide spectral diffraction of the incident light and to reflect the incident light, thus resulting in the brilliance and fire of the gemstone. However, this requires a minimal size and purity of the gemstone. For example, two thirds of the mined diamonds are not suitable for producing gemstones by cutting because they are either too small, have not the required height, or because of their color or inclusions, and therefore can only be used for industrial (technical) purposes.

The brilliance, respectively, the luster of the diamond results from the portion of the incident light impinging on the gemstone being reflected in the direction where the light is coming from. This is achieved in that the light which impinges through the upper facets into the diamond crystal is reflected at the lower brilliant or diamond area and exits through the upper facets. The light is thus reflected in at least two reflection steps by a total of approximately (180° ±x°) The arrangement of the facet angle relative to one another must take into consideration the optical properties of the boundary surface diamond/air so that the angle of total reflection is never surpassed.

It is important in the context of the beam path within the diamond that at the back facets, i.e., at the lower portion of the diamond, the angle of the light beam path is always greater than the angle of total reflection. This means that the light is reflected back upwardly, while it must impinge on the upper facets and the table with such an angle that the light can exit. Diamond brilliants are not cut such that the light is reflected exactly in the direction in which it impinges on it, as is the case for reflectors; instead, between the incident and the exiting light beam an open angle is provided which results in reflection that will impinge on the eye. The exit angle is different due to the dispersion for different wavelengths.

An important feature for the fire of the brilliant is the dispersion of light within the diamond which results in that the light is diffracted as it is in a prism and is then perceived by the eye as spectral colors.

Further effects which occur when viewing a brilliant are the many reflections which come from the facets and impinge on the eye when the brilliant is turned. These are the essential objectives that must be fulfilled by the facets.

Artificial diamond layers which are produced by CVD processes are either too expensive or too thin to produce therefrom cut gemstones, for example brilliants, which can provide the impressive luster that determines their value. Important for the luster is the adherence to a precise geometric shape in order to reflect a portion of the incident light as large as possible into the impinging light direction.

It is an object of the invention to provide artificial gemstones from precious stone layers produced by vapor phase deposition on large surface areas which, despite the unfavorable dimensions, i.e., the limited thickness of such layers, provide an attractive appearance.

SUMMARY OF THE INVENTION

This object is inventively solved with a gemstone which is comprised of a preferably plate-shaped support or substrate having one surface that is provided with at least one pyramid-shaped depression and which supports a precious stone layer that is produced by vapor phase deposition, preferably according to the CVD or PVD methods.

In order for the precious stone layer, especially diamond layer, of the inventive gemstone to have the required brilliance, its underside that is resting on a support, for example a silicon wafer, must be embodied such that, as in the case of the single crystal natural brilliance, it will produce a reflection of most of the incident light. This can be achieved by a respective pre-treatment of the surface of the silicon wafer to be coated. According to this pre-treatment, the silicon wafer has the required shape as a negative matrix (pyramid-shaped depressions) so that the backside or underside of the diamond layer to be formed will have the respective positive shape (i.e. projections that coincide with the depressions). As a support or base for such artificially produced diamond layers, silicon wafers are especially suitable but also such materials as precious metals, tungsten, molybdenum, or hard metals which can be coated easily with diamond and at whose surface a structure as required can be produced.

Producing the structure in the support to be coated can be achieved, as a function of its material, by mechanical means, i.e., cutting a certain profile, by electrolytic means or, especially in the case of silicon wafers, by chemical or plasma-technological means by etching. It is possible to employ isotropic as well as anisotropic methods. As an anisotropic etching medium, KOH can be used. This base results in the formation of pyramid-shaped etching depressions in a single-crystalline wafer. When employing an etching mask, it is also possible to produce by an isotropic etching medium a pyramid-shaped structure in a support. A suitable composition of the etching solution can produce the required angles of the pyramid. If, as mentioned above, a stepwise reflection by approximately 180°±x° is desired, the angles of the pyramid must be adapted accordingly.

The edge area of the support of the gemstone layer can be provided with other pyramid angles than the center portion. However, it is also possible to provide the reflecting surfaces (facets) at the underside of the layer with different angles. In this manner, the brilliance and the fire can be adjusted independent from one another. The angles of the facets can be selected such that the light in the gemstone layer is reflected multiple times so that a great diffraction of the spectral colors can be achieved.

It is easiest to provide with a single etching action on the entire surface of the support the same angle, having, for example, a pyramid opening angle of 109°. This angle can be achieved easily by etching processes. Before etching is carried out, the surface of the support can be subjected to a laser action in order to provide the desired geometry.

It is also possible to use wafers having other orientations than (100) or (111). Important in this context is the directed cooperation of the crystal orientation of the precious stone layer and the direction of the etching action in order to provide an optimal optical effect. In a polycrystalline artificial diamond layer produced, for example by a CVD method, in contrast to a single crystal diamond crystal grain boundaries are present which must be taken into consideration as additional refracting areas having a different refractive index. This has the consequence that the grain boundaries advantageously must be aligned with respect to their structure, for example in a column-like arrangement, in order to provide a positive effect on brilliance and fire. In any case, the effect of the grain boundary must be taken into consideration for the optical effect.

In a simple pyramid shape the light can also be refracted by providing a mirror layer on the backside or underside of the vapor phase precious stone, especially a CVD diamond, in the form of a gold or titanium layer. Then, the reflection will result from reflective action at the gold or titanium surface acting as a mirror.

In order to approximate as closely as possible the brilliance and the fire of single crystal brilliants, an octahedron shape of the surface of the artificial diamond layer is advantageous which can be cut subsequently to its production. The angles at the underside must be matched to the changed exit ratios.

These carriers, having a precious stone layer produced by vapor phase deposition, can be used as gemstones in the conventional manner, for example can be mounted on a metal body of a piece of jewelry.

The surface of the support or substrate carrying the deposited precious stone layer need not be planar. For example, it can be convex in order to provide artificial gemstones in the shape of a cabochon or button.

The invention provides for manufacture of artificial gemstones, especially diamonds, not only with special optical properties such as brilliance and fire, but also with surface dimensions, for example by multi dimensioning, that cannot be achieved even in approximation with natural stones and also not with other synthetic methods, especially not the high pressure/high temperature technology for economical and technical reasons. The inventive gemstone can be provided with its own colors employing a gas phase of a respective composition; for example, it is possible to provide a blue color by boron, or a yellow color by nitrogen. In this way the inventive gemstones can be used for any suitable piece of jewelry or any suitable decoration purpose with precious stones.

BRIEF DESCRIPTION OF THE DRAWINGS

One embodiment of the inventive gemstone will be explained with the aid of the schematic drawings, in which.

DESCRIPTION OF PREFERRED EMBODIMENTS

Figure 1:
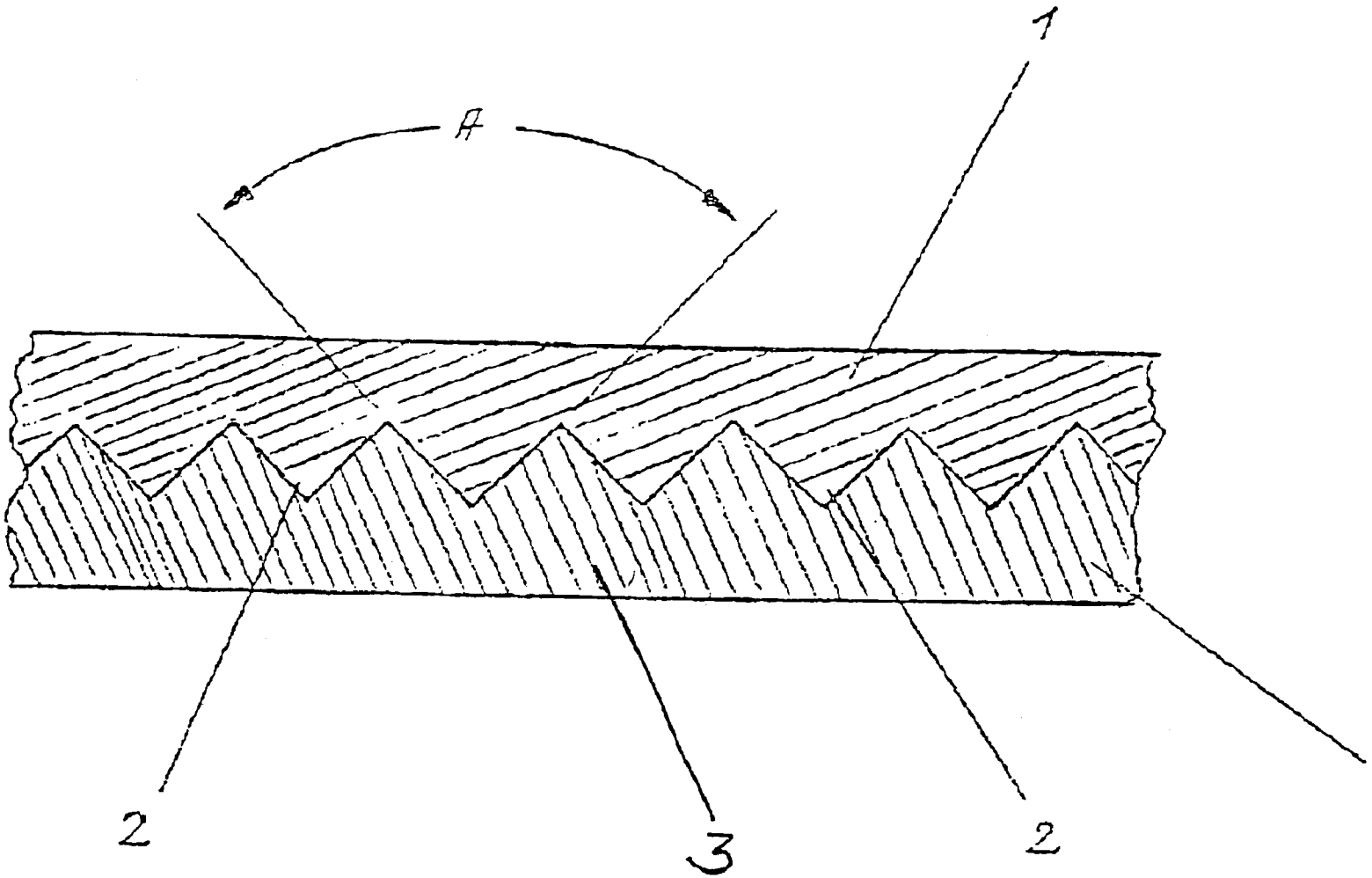
FIG. 1 is a cross-sectional view of one exemplary embodiment of an inventive gemstone.
Figure 2:
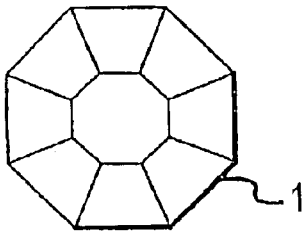
FIG. 2 is a plan view onto one area of the precious stone layer of FIG. 1.
Figure 3:
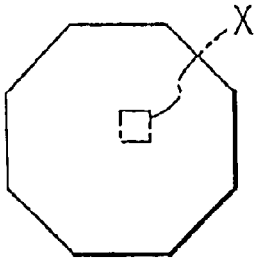
FIG. 3 is a schematic view of the precious stone layer area of FIG. 2 from below.
Figure 4:
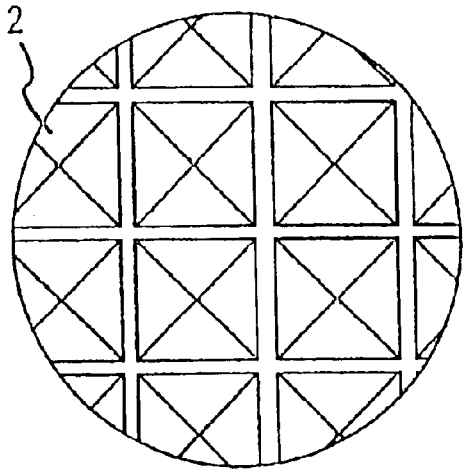
FIG. 4 shows the area X of FIG. 3 in an enlarged representation.

The precious stone layer 1 is shown in the drawings on the support 3, whereby the support has a side which is mirror-symmetrically formed relative to the precious stone layer 1, i.e. the pyramid-shaped depressions of the support 3 coincide with the pyramid-shaped projections of the layer 1.

The precious stone layer 1 has at its underside a plurality of pyramid-shaped projections 2 having an angle "A", while its upperside is provided, for example, with an octahedron facet cut.

The precious stone layer 1, which is fixedly adhered to the support 3 and is cut, thus provides the inventive gemstone which can be mounted in a piece of jewelry, for example a ring.

The support onto which the precious stone layer is to be applied need not have the dimensions of the gemstone to be produced. When a large-surface area support is used and provided with a precious stone layer, parts can be cut therefrom and then processed to a gemstone.

The specification incorporates by reference the disclosure of German priority document 297 17 496.7 filed Sep. 30, 1997 and international priority document PCT/EP 98/06074 filed Sep. 23, 1998.

The present invention is, of course, in no way restricted to the specific disclosure of the specification and drawings, but also encompasses any modifications within the scope of the appended claims.

What is claimed is:

1. A gemstone comprising:

a plate-shaped support having a surface with at least one pyramid-shaped depression, wherein said at least one pyramid-shaped depression has a mirror surface; and a vapor phase deposit layer comprising a precious synthetic gemstone layer disposed on said plate-shaped support and having an upper surface facing away from said plate-shaped support and an underside having at least one pyramid-shaped projection disposed in and coinciding with said at least one pyramid-shaped depression of said support, said precious synthetic gemstone layers include grain boundaries that are aligned in a column shape, wherein side faces of the faces of said at least one pyramid-shaped projection of said underside of said vapor phase deposit layer upon said plateshaped support impart decorative light-reflective qualities to said synthetic gemstone layer.

2. A gemstone according to claim 1, wherein said plate-shaped support is a silicon wafer.

3. A gemstone according to claim 1, wherein said silicon wafer has (100) or (111) orientation.

4. A gemstone according to claim 1, wherein said plate-shaped support is comprised of a precious metal.

5. A gemstone according to claim 1, wherein said plate-shaped support is comprised of a metal, said metal having a hardness sufficient to support said precious stone layer upon said plate-shaped support.

6. A gemstone according to claim 1, wherein said plate-shaped support is comprised of a refractive metal.

7. A gemstone according to claim 6, wherein said metal is tungsten or molybdenum.

8. A gemstone according to 1, wherein said at least one pyramid-shaped depression is produced mechanically.

9. A gemstone according to claim 8, wherein said at least one pyramid-shaped depression is produced by cutting or stamping.

10. A gemstone according to 1, wherein said at least one pyramid-shaped depression is produced by etching.

11. A gemstone according to claim 1, wherein pyramid angles of said at least one pyramid-shaped depression comprise differing angle measurements.

12. A gemstone according to claim 1, wherein said at least one pyramid-shaped depression includes pyramid angles measuring approximately 109°.

13. A gemstone according to claim 1, wherein an upper surface of said precious stone layer facing away form said plate-shaped support is cut.

14. A gemstone according to claim 1, wherein said precious stone layer has a color produced by doping.

15. A gemstone according to claim 1, wherein a surface of said plate-shaped support, on which said precious stone layer is supported, is curved.

* * * * *